US009991613B2

(12) United States Patent
Wu et al.

(10) Patent No.: US 9,991,613 B2
(45) Date of Patent: Jun. 5, 2018

(54) WIRE DETACHMENT-PREVENTING STRUCTURE

(71) Applicant: Panasonic Ecology Systems Guangdong Co., Ltd., Guangdong (CN)

(72) Inventors: Kunran Wu, Guangdong (CN); Bodong Zhong, Guangdong (CN)

(73) Assignee: PANASONIC ECOLOGY SYSTEMS GUANGDONG CO., LTD., Guangdong (CN)

( * ) Notice: Subject to any disclaimer, the term of this patent is extended or adjusted under 35 U.S.C. 154(b) by 0 days. days.

(21) Appl. No.: 15/708,444

(22) Filed: Sep. 19, 2017

(65) Prior Publication Data

US 2018/0090858 A1 Mar. 29, 2018

(30) Foreign Application Priority Data

Sep. 28, 2016 (CN) ..... 2016 2 1088654 U

(51) Int. Cl.
*H01R 9/22* (2006.01)
*H01R 9/24* (2006.01)
*H01R 103/00* (2006.01)

(52) U.S. Cl.
CPC ..... *H01R 9/2416* (2013.01); *H01R 9/223* (2013.01); *H01R 2103/00* (2013.01)

(58) Field of Classification Search
CPC .... H01R 9/2416; H01R 9/223; H01R 4/2433; H02G 3/0691
See application file for complete search history.

(56) References Cited

U.S. PATENT DOCUMENTS 4,864,080 A * 9/1989 Fochler ..... H02G 3/0691 174/664
5,207,186 A * 5/1993 Okita ..... F01P 1/06 123/198 E
5,626,490 A * 5/1997 Pitts ..... H01R 4/2433 439/404
8,858,280 B1 * 10/2014 Wiegele ..... B63H 20/32 123/195 C

* cited by examiner

*Primary Examiner* — Jean F Duverne
(74) *Attorney, Agent, or Firm* — RatnerPrestia

(57) ABSTRACT

A wire detachment-preventing structure includes: a circuit board box, a housing provided with a wiring outlet and constituting the circuit board box, a terminal block for connecting a wire and provided on the circuit board box and provided with a wiring inlet; the circuit board box is provided with a wire detachment-preventing rib, the wiring inlet and the wiring outlet are provided on one same side of the wire detachment-preventing rib, a first passageway is formed between the wiring outlet and the wire detachment-preventing rib, a second passageway is formed between the wire detachment-preventing rib and the housing, and the wire from the wiring outlet bypasses the wire detachment-preventing rib through the second passageway and leads to the wiring inlet through the first passageway so as to form a U shape. By use of the wire detachment-preventing rib, the wire is not easily detached from the wiring inlet.

5 Claims, 6 Drawing Sheets

WIRE DETACHMENT-PREVENTING STRUCTURE

BACKGROUND OF THE INVENTION

Field of the Invention

The present disclosure relates to the field of wire mounting and fixing techniques, and more particularly to a wire detachment-preventing structure.

Description of the Related Art

A clamping device is usually used to clamp a cable in the conventional or existing wire mounting and fixing techniques, as shown in FIGS. 1A and 1B, which show a conventional clamping device comprising a base plate 1 and a clamping plate 2 provided on the base plate 1, wherein one end of the clamping plate 2 is rotatably connected on the base plate 1 such that the clamping plate 2 may rotate relative to the base plate 1, and a middle portion 3 of the clamping plate 2 is used to secure a cable 4 to the base plate 1, and the other end of the clamping plate 2 is securely attached to the base plate 1 by a fixing screw 5 so as to prevent the power supply cable 4 from being detached from a wiring terminal.

However, for the above-mentioned clamping device, for the purpose of securing the power supply cable, the distance between the clamping plate 2 and the base plate 1 should be smaller than the diameter of the power supply cable 4. In addition, due to the fixing screw 5, the power supply cable will be compressed such that the power supply cable 4 will deform as shown in the FIGS. 1A and 1B, and as result of it, an insulation layer of the power supply cable 4 located between the clamping plate 2 and base plate 1 will be damaged or even broken up, resulting in current leakage. The power supply cable may lose its original elasticity after long-term deformation such that the diameter of the power supply cable 4 located between the clamping plate 2 and the base plate 1 becomes smaller than the distance between the clamping plate 2 and the base plate 1, and the power supply cable is thus easily loosened.

Moreover, upon the use of this structure, there is still a need for the fixing screw 5 and a hole perforated in the base plate 1. Usually, the hole may be perforated in a product such as a circuit board box, thereby reducing the water proof performance of the product and complicating the installation and maintenance operations of the product.

SUMMARY OF THE INVENTION

(I) Technical Problems to be Solved

The present disclosure provides a wire detachment-preventing structure which may reduce cost and installation time while preventing a wire from being detached from a wiring inlet due to a pulling force.

(B) Technical Solution

In one aspect of the present disclosure, there is provided a wire detachment-preventing structure, a circuit board box, a housing constituting the circuit board box, a terminal block for connecting a wire and provided on the circuit board box, wherein the terminal block is provided with a wiring inlet for leading the wire into the circuit board box, the housing is provided with a wiring outlet for leading the wire outside the housing, the wire extends from the wiring inlet to the wiring outlet, the circuit board box is provided with a wire detachment-preventing rib, the wiring inlet and the wiring outlet are both provided on one same side of the wire detachment-preventing rib, a first passageway for passing the wire therethrough is formed between the wiring outlet and the wire detachment-preventing rib, a second passageway for passing the wire therethrough is formed between the wire detachment-preventing rib and the housing, and the wire from the wiring outlet bypasses the wire detachment-preventing rib through the second passageway and is leaded into the wiring inlet through the first passageway so as to form a U shape.

Preferably, the wire detachment-preventing rib is provided with an opening having a diameter equal to or greater than the diameter of the wire, and when viewed from the front of the wiring outlet, the opening is offset from the wiring outlet.

Preferably, the terminal block is provided with a fixing portion for fixing the wire, and a plane on which the wiring inlet is formed and a sidewall of the housing on which the wiring outlet is provided form an angle less than 90 degrees therebetween such that the wiring inlet is inclined towards the wiring outlet.

Preferably, the wire detachment-preventing rib is of a flat-plate shape and comes into contact with the wire at at least two contact points, and a certain distance is kept between any two of contact points.

Preferably, the terminal block comprises a first terminal block for receiving strong current and a second terminal block for receiving weak current, and an insulation wall is provided between the first terminal block and the second terminal block.

(C) Beneficial Effects

As can be seen from the above technical solutions, the wire detachment-preventing structure of the present disclosure has at least one of the following advantageous effects:

(1) by utilizing the wire detachment-preventing rib, the wiring inlet and the wiring outlet of the wire detachment-preventing structure, when the wire is pulled in the direction towards the wiring outlet, the wire may come in contact with the wire detachment-preventing rib so as to produce the friction force for counteracting the outward-pulling force such that the wire is not easily pulled off and detached from the wiring inlet;

(2) as compared with the manner in which the wire is fixed by the clamping plate, only a wire detachment-preventing rib is required in the present disclosure, and it is not necessary to provide a screw hole and a screw, etc., and the situation that the wire detachment-preventing effect is lost due to the loosened screw caused by the abrasion may not appear again, thereby saving cost and installation time; and there is no need to apply a force to fix the wire such that the wire may not be damaged;

(3) the wire detachment-preventing rib is further provided with an opening, and thus the present disclosure may prevent the pulled wire from being detached from the wiring inlet while achieving the effect of facilitating the connection of the wire;

(4) the angle formed between the plane on which the wiring inlet is formed and the sidewall of the housing on which the wiring outlet is provided is smaller than 90 degrees such that the user can observe simultaneously the wiring inlet and the fixing portion on the terminal block for easy installation and maintenance;

(5) the wire detachment-preventing rib is of a flat-plate shape and comes into contact with the wire at two contact points or more than two contact points, and a certain distance is kept between any two of the contact points so as to effectively prevent the wire from being detached from the wiring inlet; and (6) the terminal block for receiving strong current and the terminal block for receiving weak current are separated from each other by an insulation wall provided between two terminal blocks so as to prevent short circuit caused by incorrect connection and ensure the security of the product and the user.

BRIEF DESCRIPTION OF THE DRAWINGS

FIGS. 1A and 1B are schematic views of a conventional clamping device, wherein FIG. 1A is a plan view and FIG. 1B is a side view;

FIGS. 5A and 5B are partial enlarged views of the wire detachment-preventing structure shown in FIG. 2, wherein FIG. 5A is a side view and FIG. 5B is a cross-sectional view;

DESCRIPTION OF REFERENCE NUMERALS

1—base plate; 2—clamping plate; 3—middle portion of clamping plate; 4—cable; 5—screw;

10—circuit board box, 11—housing; 12—sidewall provided with wiring outlet;

20—terminal block 21: fixing portion 22: first terminal block 23: second terminal block 24: insulation wall;

30—wire detachment-preventing rib; 31—opening;

40—wiring inlet; 50—wiring outlet;

60—wire;

70—pipe; 80—angle.

DETAILED DESCRIPTION OF PREFERRED EMBODIMENTS OF THE INVENTION

The present disclosure will be described in further detail with reference to the accompanying drawings so as to obtain more comprehensive understanding of the purpose, the technical solution and the advantages of the present disclosure.

Figure 1A:
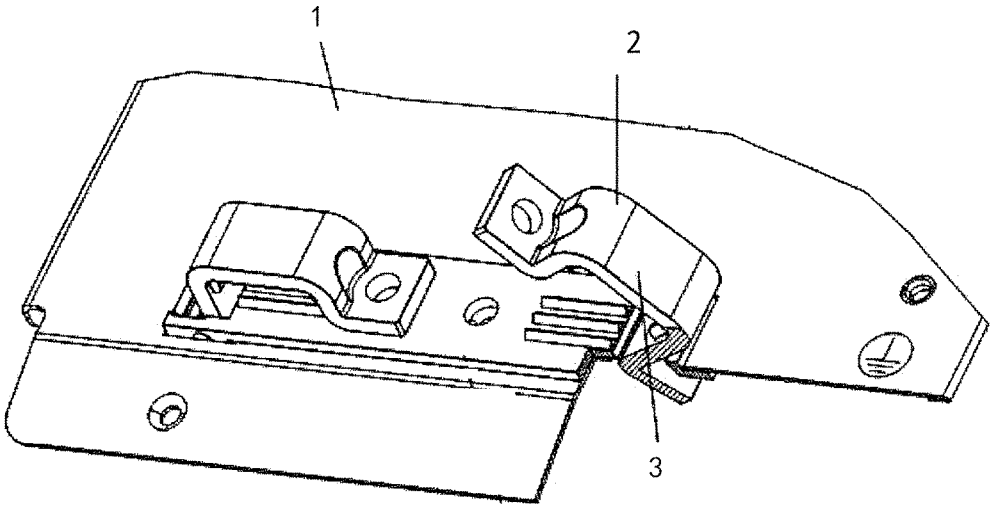
Fig.1A PRIOR ART
Figure 1B:
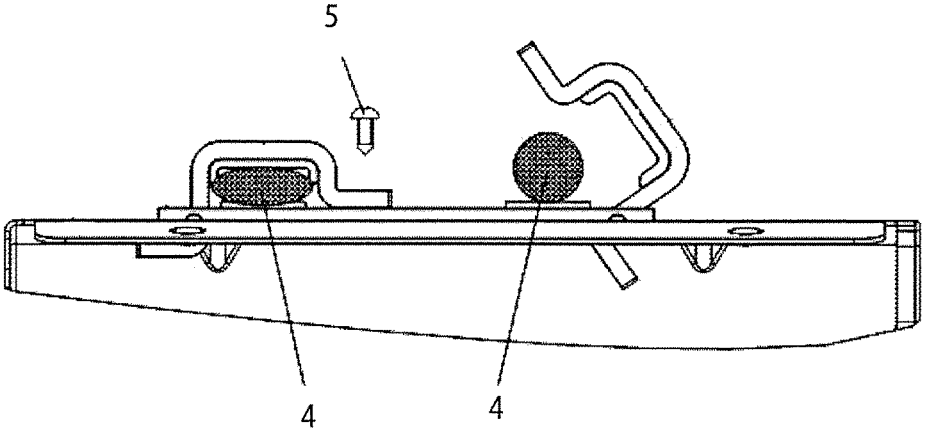
Fig.1B PRIOR ART
Figure 2:
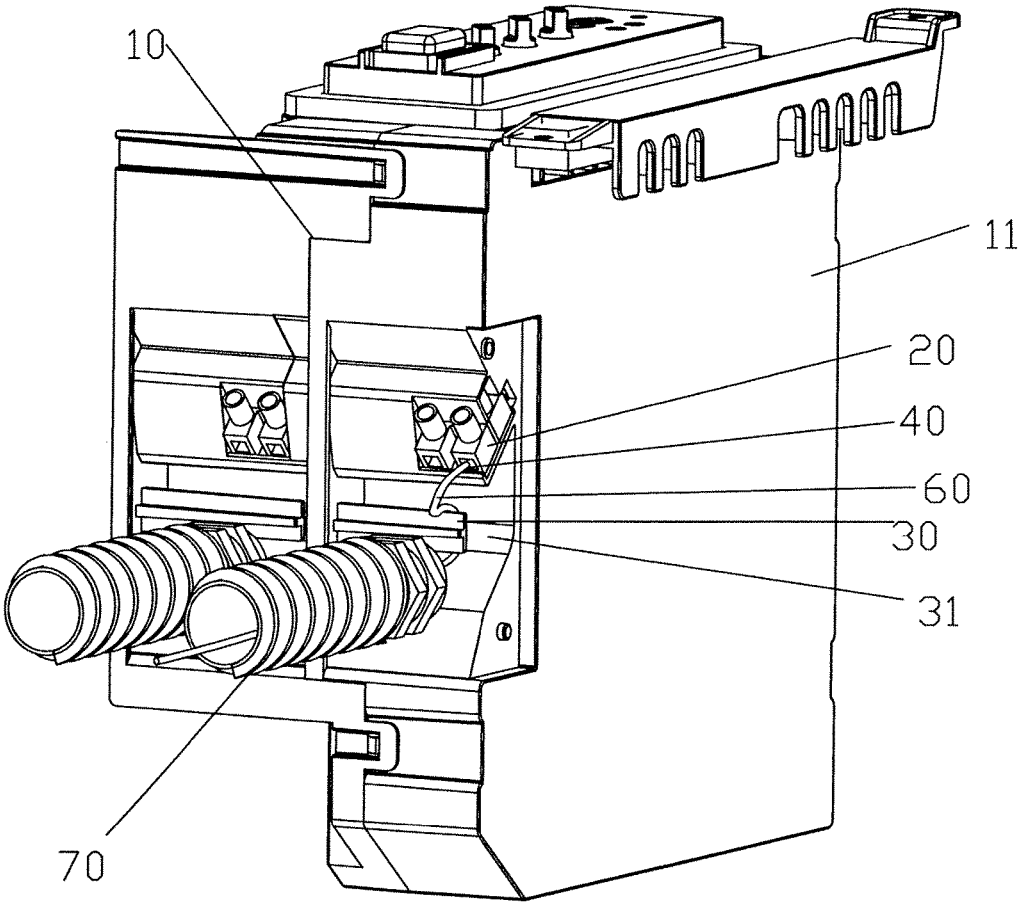
FIG. 2 is a schematic view of a wire detachment-preventing structure according to an embodiment of the present disclosure.
Figure 3:
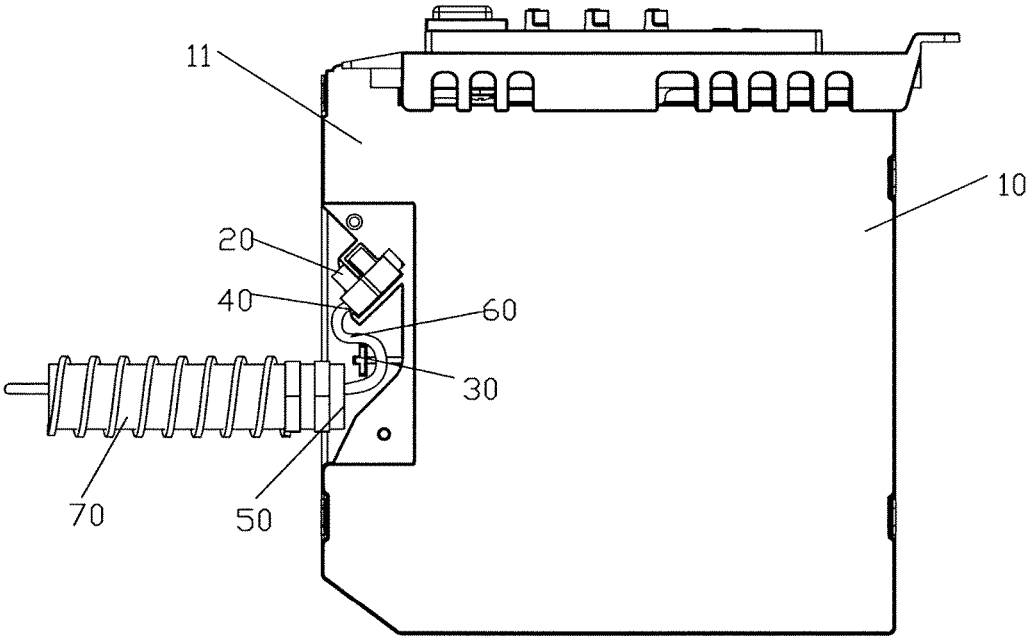
FIG. 3 is a cross-sectional view of the wire detachment-preventing structure shown in FIG. 2.

The present disclosure provides a wire detachment-preventing structure for mounting and fixing a wire 60, as shown in FIGS. 2 and 3, comprising: a circuit board box 10, a terminal block 20 and a wire detachment-preventing rib 30.

The terminal block 20 is provided on the circuit board box 10 and provided with a wiring inlet 40 for receiving the wire 60 so as to connect the wire 60 to the circuit board box 10.

The circuit board box 10 includes a housing 11 provided with a wiring outlet 50. The wire 60 extends from the wiring inlet 40 to the wiring outlet 50 and then extends outside of the housing 11 via the wiring outlet 50.

The wire detachment-preventing rib 30 is provided on the circuit board box 10. The wiring inlet 40 and the wiring outlet 50 are provided on one same side of the wire detachment-preventing rib 30. A first passageway for passing the wire 60 therethrough is formed between the wiring outlet 40 and the wire detachment-preventing rib 30, a second passageway for passing the wire 60 therethrough is formed between the wire detachment-preventing rib 30 and the housing 11, and a third passageway for passing the wire 60 therethrough is formed between the wire detachment-preventing rib 30 and the wiring outlet 50. The wire 60 from the wiring outlet 50 bypasses the wire detachment-preventing rib 30 through the second passageway and is leaded into the wiring inlet 40 through the first passageway so as to form a U shape.

In the present disclosure, the wiring outlet 50 refers to an opening through which the wire 60 extending from the wiring inlet 40 passes so as to extend outside of the circuit board box 10, and may be provided on one sidewall of the housing 11 of the circuit board box 10 or may be provided on the product frame. In addition, in order to protect the wire, a pipe 70 may be provided. Since the wire passes through the pipe 70, the opening of the pipe is considered as the wiring outlet 50. If the duct 70 is not provided, the wiring outlet 50 is an opening located on one of the sidewalls of the housing constituting the circuit board box and provided to allow the wire to extend outside of the housing.

The wire detachment-preventing rib 30 disposed on the circuit board box 10 extends in a first direction perpendicular to the projection of a connection line between the wiring inlet 40 and the wiring outlet 50 in a horizontal plane. Alternatively, the first direction has a component in a direction perpendicular to the projection of the connection line between the wiring inlet 40 and the wiring outlet 50 in the horizontal plane. In addition, a straight-line distance between the terminal block 20 and the wire detachment-preventing rib 30 is equal to or greater than the diameter of the wire, and a straight-line distance between the wire detachment-preventing rib 30 and the housing 11 of the circuit board box 10 is equal to or greater than the diameter of the wire.

Since the wiring inlet 40 and the wiring outlet 50 are located on one same side of the wire detachment-preventing rib, when the user performs the connection of the wire, the wire 60 passes through the third passage at a side of the wire detachment-preventing rib 30 adjacent to the wiring outlet 50, and then passes through the second passageway between the wire detachment-preventing rib 30 and the housing 11, and finally is leaded into the wiring inlet 40 via the first passageway on a side of the wire detachment-preventing rib 30 adjacent to the wiring inlet 40. In other words, the wire 60 needs to bypass the wire detachment-preventing rib 30 and then to be leaded into the wiring inlet 40, thereby forming a "U" shape. When the wire 60 is pulled in the direction of the wiring outlet 50, the wire 60 comes into contact with the wire detachment-preventing rib 30 and is subjected to the interference from the wire detachment-preventing rib 30 so as to produce a friction force against the outward-pulling force. The friction force is counteracted by the outward-pulling force, such that the wire 60 is not easily pulled outwardly and detached from the wiring inlet 40.

In FIG. 2 and FIG. 3, the wiring inlet 40 and the wiring outlet 50 are located on one same side of the wire detachment-preventing rib 30, and the wiring outlet 50 is located below the wire detachment-preventing rib 30. However, for the wire detachment-preventing structure of the present disclosure, the wiring outlet 50 can be shifted upwards such that the wiring outlet 50 and the wiring inlet 40 are located on one same side of the wire detachment-preventing rib 30, and the wiring outlet 50 is also located above the wire detachment-preventing rib 30. In this way, when the user performs the connection of the wire, the wire 60 passes through the third passage formed between the wiring outlet 50 and the wire detachment-preventing rib 30 via the wiring outlet 50, and then passes through the second passageway between the wire detachment-preventing rib 30 and the housing 11, and finally is leaded into the wiring inlet 40 via the first passageway on a side of the wire detachment-preventing rib 30 adjacent to the wiring inlet 40.

In this way, the wire 60 may also bypass the wire detachment-preventing rib 30 and then is leaded into the wiring inlet 40, thereby forming a "U" shape, such that when the wire 60 is pulled in the direction of the wiring outlet, the friction force produced between the wire 60 and the wire detachment-preventing rib 30 is counteracted by the outward-pulling force and the wire 60 is not easily pulled outwardly and detached from the wiring inlet 40. When the circuit board box 10 is installed on the ceiling, or installed on the wall, or placed on the ground, regardless of the routing direction of the wire extending from the wiring outlet 50 of the circuit board box 10 relative to the ground, regardless of the directions of the force applied on the wire relative to the ground, since the wiring inlet 40 and the wiring outlet 50 are located on one same side of the wire detachment-preventing rib 30, that is, on a side where the pulling force is applied, the wire 60 may come into contact with the wire detachment-preventing rib 30 so as to produce a friction force for counteracting the pulling force and so that the wire 60 is not easy to be loosened, regardless of the routing direction of the wire 60 at outside of the product frame during the installation.

At the same time, as compared with the manner in which the wire is fixed by the clamping plate in the prior art, the present disclosure requires only a wire detachment-preventing rib, and it is not necessary to provide a screw hole and a screw, etc., and the situation that the wire detachment-preventing effect is lost due to the loosened screw caused by abrasion may not appear again, thereby saving cost and installation time.

In addition, because there is no need to apply pressing force on the wire to be fixed, the wire may not be damaged. It can be seen that regardless of the installation state of the product, the wire is not easy to be loosened, thereby reducing cost and protecting the wire.

Figure 4:
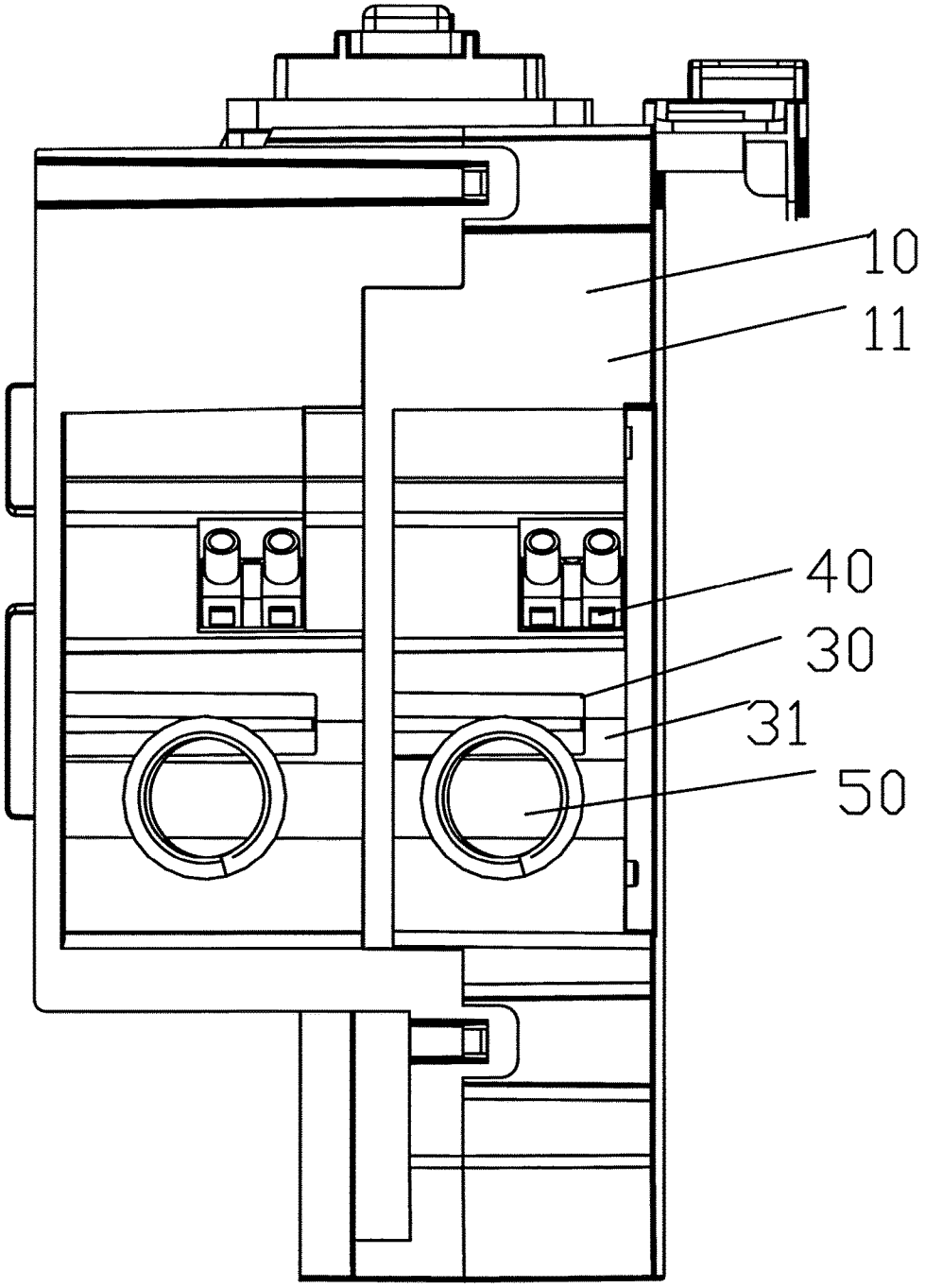
FIG. 4 is a front view of the wire detachment-preventing structure shown in FIG. 2.

As shown in FIG. 4, the wire detachment-preventing rib 30 is further provided with an opening 31 which has a diameter equal to or greater than the diameter of the wire 60. As seen from the front of the wiring outlet 50, the opening 31 is completely offset from the wiring outlet 50, that is, the wire detachment-preventing rib 30 covers the diameter of the wiring outlet 50.

In this way, when the user performs the connection of the wire 60, the wire 60 can be entered into the second passageway formed between the wire detachment-preventing rib 30 and the housing 11 via the opening 31, and then be moved to an end of the wire detachment-preventing rib 30 far away from the opening 31 and then be leaded into the wiring inlet 40 so as to facilitate the wire connection and the operation of the user. At the same time, since the opening 31 and the wiring outlet 50 are offset from each other, even if the wire detachment-preventing rib 30 does not cover the wiring inlet 40, when the wire 60 is pulled, the pulling direction is directed toward the wiring outlet 50 and naturally away from the opening 31 on the wire detachment-preventing rib 30, and the wire 60 at a side of the wire detachment-preventing rib 30 adjacent to the wiring outlet 50 may still come into contact with the wire detachment-preventing rib 30, thereby producing the friction force for counteracting the pulling force and preventing the wire 60 from being detached from the wiring inlet 40 due to being pulled. On the contrary, when the opening 31 and the wiring outlet 50 are not offset from each other, even if the wire detachment-preventing rib 30 covers the wiring inlet 40, when the wire 60 is pulled, the wire 60 at a side of the wire detachment-preventing rib 30 adjacent to the wiring outlet 50 may be moved towards the opening 31 by the pulling force such that the wire 60 slips off from the opening 31 and may not come into contact with the wire detachment-preventing rib 30 anymore, and the friction force for counteracting the pulling force may not be produced and the wire 60 may thus be readily detached from the wiring inlet 40 by being pulled. Therefore, the above structure may prevent the pulled wire 60 from being detached from the wiring inlet 40 while facilitating the connection of the wire.

Figure 5A:
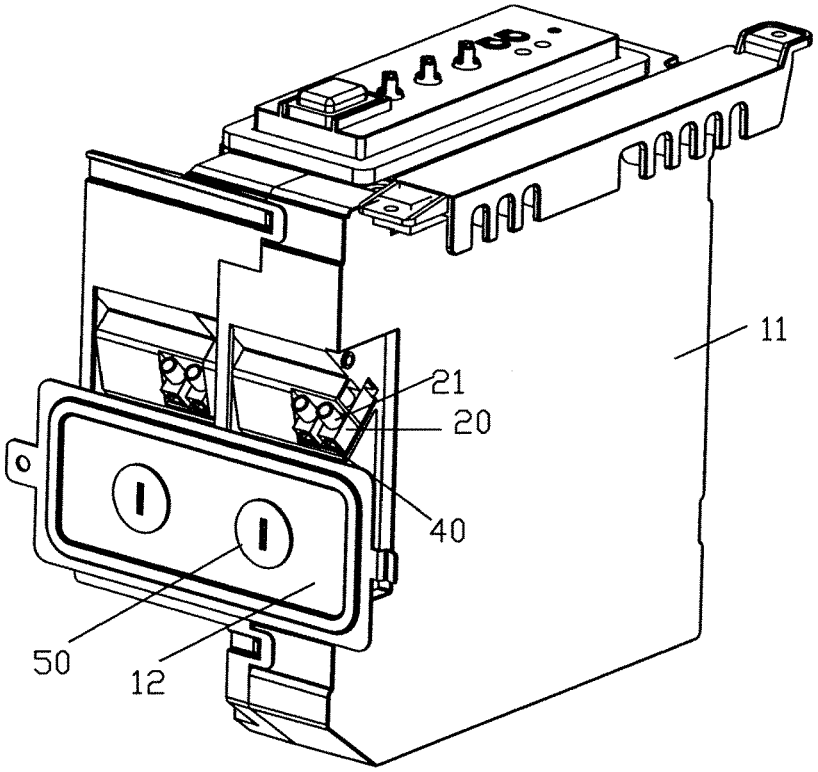
Figure 5B:
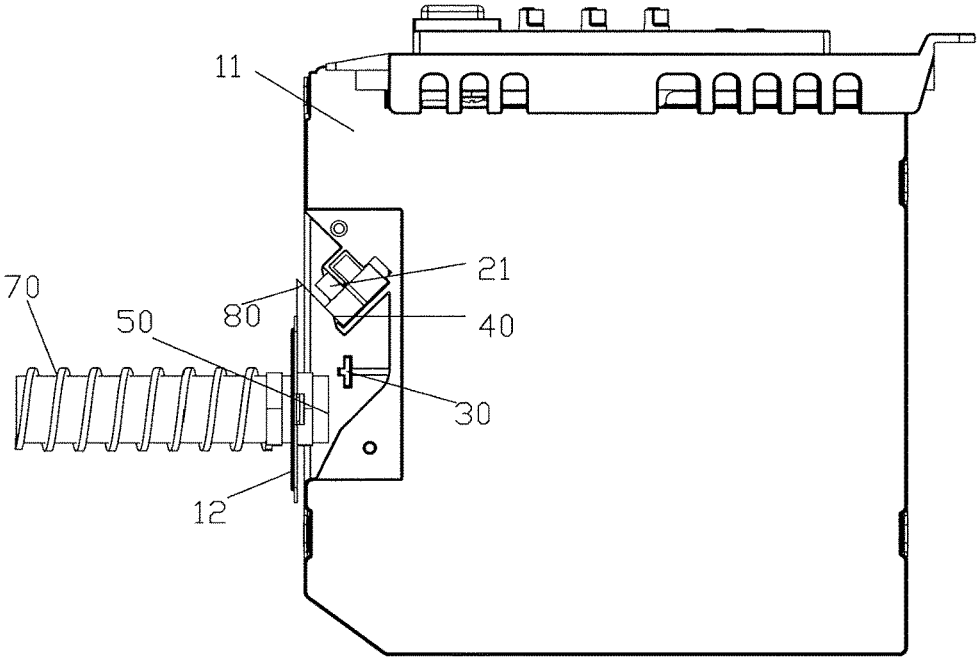

As shown in FIGS. 5A and 5B, the terminal block 20 is provided with a fixing portion 21 for fixing the wire 60 in the wiring inlet 40, and the wiring inlet 40 and the fixing portion 21 are arranged such that there is an "L" shape formed therebetween. The wiring inlet 40 is inclined towards the wiring outlet 50 such that the plane on which the wiring inlet 40 is formed and a sidewall 12 of the housing on which the wiring outlet 50 is provided form an angle 80 less than 90 degrees therebetween.

For the wire detachment-preventing structure of the present disclosure, if the angle 80 formed between the plane on which the wiring inlet 40 is formed and the sidewall 12 of the housing on which the wiring outlet 50 is provided is equal to or larger than 90 degrees, the wiring inlet 40 is inclined facing the housing 11. When the user performs the connection of the wire, the wire 60 must be pulled into the passageway formed between the wiring inlet 40 and the housing 11 and then be leaded into the wiring inlet 40 facing the housing 11. Since the passageway between the wiring inlet 40 and the housing 11 is quite narrow in such case, it is not easy for the user to operate. In addition, since the wiring inlet 40 and the wiring outlet 50 are not located on one same side of the wire detachment-preventing rib 30 in such case, when the wire 60 is pulled in the direction towards the wiring outlet 50, the wire 60 may not come into contact with the wire detachment-preventing rib 30 such that friction force is not produced and thus the wire 60 may be readily detached from the wiring inlet 40.

If the angle 80 formed between the plane on which the wiring inlet 40 is formed and the sidewall 12 of the housing on which the wiring outlet 50 is provided is smaller than 90 degrees such that the wiring inlet 40 is inclined towards the wiring outlet 50, the user can observe simultaneously the wiring inlet 40 and the fixing portion 21 on the terminal block 20 for easy installation and maintenance. Preferably, the angle 80 formed between the plane on which the wiring inlet 40 is formed and the sidewall 12 of the housing on which the wiring outlet 50 is provided is about 45 degrees.

For the wire detachment-preventing structure of the present disclosure, if there is only one contact point between the wire detachment-preventing rib 30 and the wire 60, the friction force generated by the contact between them in an opposite direction to the pulling force is not sufficient to counteract the pulling force due to the insufficient contact area, and the wire 60 is thus readily detached from the wiring inlet 40 by being pulled. To this end, as shown in FIGS. 5A and 5B, the wire detachment-preventing rib 30 is of a flat-plate shape and comes into contact with the wire 60 at at least two contact points, wherein a certain distance is kept between two of the contact points such that the friction force between the wire 60 and the wire detachment-preventing rib 30 increases so as to effectively prevent the wire 60 from being detached from the wiring inlet 40.

At the same time, if the distance between the two contact pointes is relatively small, the wire is suffered from a less friction force and is still easy to move on the wire detachment-preventing rib 30 in the left-right direction so as to slide out from the opening 31. After getting rid of the contact with the wire detachment-preventing rib 30, the wire 60 is lack of friction force and is easy to be detached from the wiring inlet 40. To this end, two contact points between the wire 60 and the wire detachment-preventing rib 30 are provided to keep the certain distance therebetween so as to further increase the friction force between the wire 60 and the wire detachment-preventing rib 30 and effectively prevent the wire 60 from being detached from the wiring inlet 40.

Figure 6:
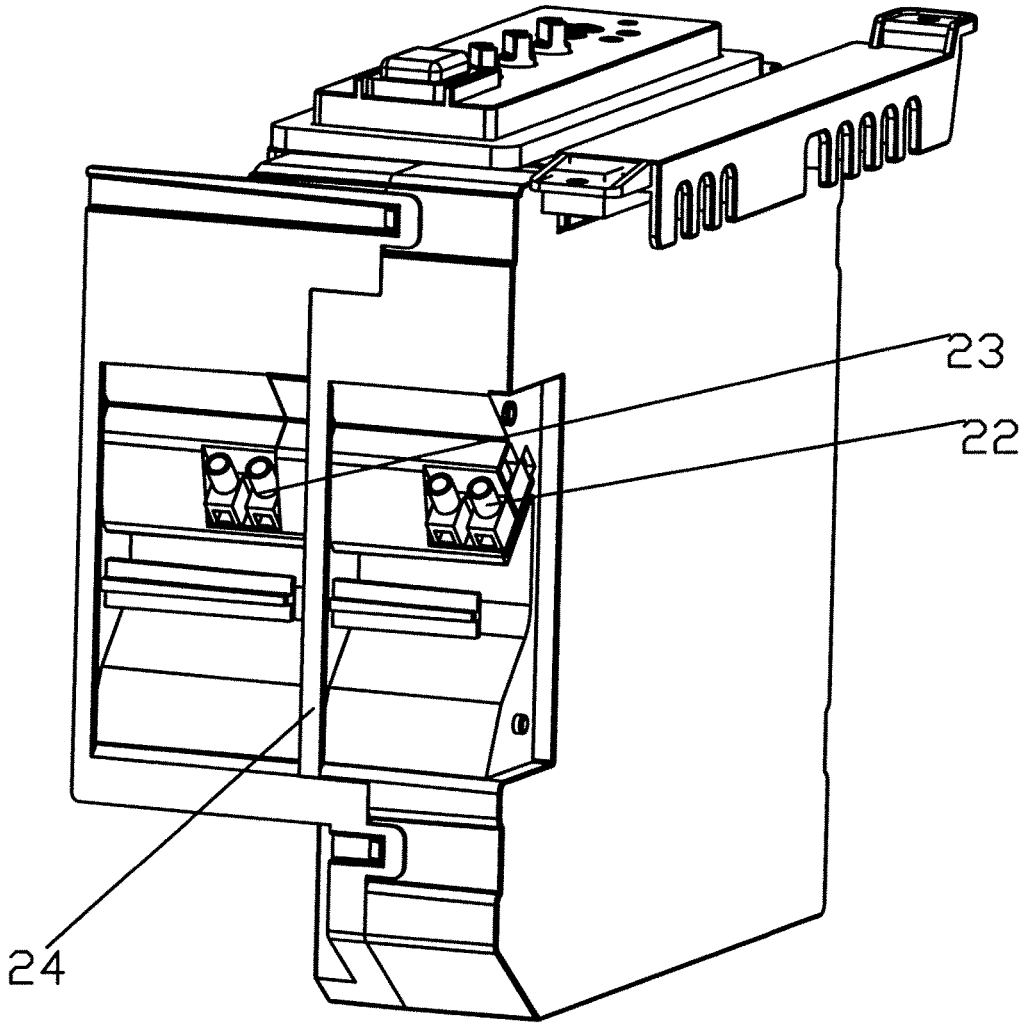
FIG. 6 is another schematic structural view of the wire detachment-preventing structure according to an embodiment of the present disclosure.

When the user performs the connection of the wire as required, if the wire for receiving weak current is incorrectly leaded into a wiring inlet on the terminal block provided for the wire for receiving strong current the danger of fire due to short circuit may be caused. To this end, as shown in FIG. 6, the terminal block 20 of the present disclosure comprise a first terminal block 22 for receiving strong current and a second terminal block 23 for receiving weak current. An insulation wall 24 is provided between the first terminal block 22 and the second terminal block 23 which are provided in parallel.

As can be seen from the above, in the present disclosure, the terminal block 22 for receiving strong current and the terminal block 23 for receiving weak current are separately provided as the first terminal block and the second terminal block. In addition, the insulation wall 24 is provided between the first terminal block 22 and the second terminal block 23 so as to prevent the incorrect connection of the wire and the resultant short circuit, ensuring the security of the product and the user.

Heretofore, the present embodiment has been described in detail with reference to the drawings. Based on the above description, those skilled in the art will have a clear understanding of the wire detachment-preventing structure of the present disclosure.

It is to be understood that the embodiment not shown or described in the text of the drawings or description are the implements known to those of ordinary skill in the art and are not described in detail. In addition, the above-mentioned definitions of the elements are not limited to the various specific structures and shapes mentioned in the embodiments, and one of ordinary skill in the art can simply change or replace them.

In view of the above, the present disclosure utilizes the wire detachment-preventing rib, the wiring inlet and the wiring outlet of the wire detachment-preventing structure, so that the wire is not easily pulled off and is not readily detached from the wiring inlet, thereby saving cost and installation time and facilitating wiring and maintenance and ensuring the safety of the products and the users.

The foregoing detailed embodiment has further described the objects, technical solutions and advantages of the present disclosure in detail. However, it should be understood that the forgoing embodiment is only the specific embodiments of the present disclosure and is not intended to limit the scope of the present disclosure. Any modifications, equivalents, improvements, etc., which are within the spirit and principles of the present disclosure, are intended to be included within the scope of the present disclosure.

What is claimed is:

1. A wire detachment-preventing structure, comprising:

a circuit board box, a housing constituting the circuit board box, a terminal block for connecting a wire and provided on the circuit board box, wherein the terminal block is provided with a wiring inlet for leading the wire into the circuit board box, the housing is provided with a wiring outlet for leading the wire outside the housing, the wire extends from the wiring inlet to the wiring outlet;

the circuit board box is provided with a wire detachment-preventing rib, the wiring inlet and the wiring outlet are both provided on one same side of the wire detachment-preventing rib with respect to the wire detachment-preventing rib, a first passageway for passing the wire therethrough is formed between the wiring outlet and the wire detachment-preventing rib, a second passageway for passing the wire therethrough is formed between the wire detachment-preventing rib and the housing, and the wire from the wiring outlet bypasses the wire detachment-preventing rib through the second passageway and is lead to the wiring inlet through the first passageway so as to form a U shape.

2. The wire detachment-preventing structure as claimed in claim 1, wherein, the wire detachment-preventing rib is provided with an opening having a diameter equal to or greater than the diameter of the wire, and when viewed from the front of the wiring outlet, the opening is offset from the wiring outlet.

3. The wire detachment-preventing structure as claimed in claim 1, wherein, the terminal block is provided with a fixing portion for fixing the wire, and a plane on which the wiring inlet is formed and a sidewall of the housing on which the wiring outlet is provided form an angle less than 90 degrees therebetween such that the wiring inlet is inclined towards the wiring outlet.

4. The wire detachment-preventing structure according to claim 2, wherein, the wire detachment-preventing rib is of a flat-plate shape and comprises at least two contact points with the wire, a certain distance being kept between any two of the contact points.

5. The wire detachment-preventing structure of claim 1, wherein the terminal block comprises a first terminal block for receiving strong current and a second terminal block for receiving weak current, and an insulation wall is provided between the first terminal block and the second terminal block.

* * * * *